US012599166B2

(12) United States Patent
McDaniel

(10) Patent No.: US 12,599,166 B2
(45) Date of Patent: Apr. 14, 2026

(54) SMOKING PIPES

(71) Applicant: VPR Brands, LP, Ft Lauderdale, FL (US)

(72) Inventor: Kegan McDaniel, Milwaukee, WI (US)

(73) Assignee: VPR Brands, LP

( * ) Notice: Subject to any disclaimer, the term of this patent is extended or adjusted under 35 U.S.C. 154(b) by 597 days.

(21) Appl. No.: 17/863,679

(22) Filed: Jul. 13, 2022

(65) Prior Publication Data

US 2024/0016204 A1 Jan. 18, 2024

(51) Int. Cl.
*A24F 1/02* (2006.01)
*A24F 5/10* (2006.01)

(52) U.S. Cl.
CPC . *A24F 1/02* (2013.01); *A24F 5/10* (2013.01)

(58) Field of Classification Search
CPC ..... A24F 1/00; A24F 5/10; A24F 19/0042; A24F 1/28; A24F 2700/00
See application file for complete search history.

(56) References Cited

U.S. PATENT DOCUMENTS 1,905,293 A * 4/1933 Jenkins ..... A24F 1/00 131/213
1,943,907 A 1/1934 Watry
2,108,423 A * 2/1938 Ashley ..... A24F 1/00 131/203
2,268,284 A * 12/1941 Hopkins ..... A24F 13/06 131/203
5,300,139 A * 4/1994 Lin ..... A24F 19/0042 55/467
5,832,935 A * 11/1998 Heine ..... A24F 1/00 131/226
2002/0020673 A1* 2/2002 Nohren ..... B01D 39/2065 210/660
2003/0221697 A1* 12/2003 Erickson ..... A24F 1/28 131/228
2009/0032034 A1* 2/2009 Steinberg ..... A24D 3/17 131/194
2013/0014773 A1* 1/2013 Steinberg ..... A24F 1/28 131/329
2021/0392947 A1* 12/2021 Folmann ..... A24F 1/22

OTHER PUBLICATIONS

Genius, "How It Works", url:<https://geniuspipe.com/pages/how-it-works>, retrieved Jul. 26, 2022, 6 pages.

(Continued)

*Primary Examiner* — Philip Y Louie
*Assistant Examiner* — Oluwatosin O Diyan
(74) *Attorney, Agent, or Firm* — Hanley, Flight & Zimmerman, LLC

(57) ABSTRACT

Smoking pipes are described herein. An example smoking pipe includes a body including a bowl to receive smoking material, a first end, a second end opposite the first end, the second end defining a first opening for smoking, and a channel defined in the body between the bowl and the first opening. The smoking pipe also includes a cover defining a second opening. The body extends through the second opening of the cover. The cover is slidable in a longitudinal direction along the body between a first position in which the bowl is accessible and a second position in which the bowl is covered.

19 Claims, 8 Drawing Sheets

(56) References Cited

OTHER PUBLICATIONS

International Searching Authority, "International Search Report," issued in connection with International Application No. PCT/US23/27468, mailed on Jan. 4, 2024, 4 pages.
International Searching Authority, "Written Opinion of the International Searching Authority," issued in connection with International Application No. PCT/US23/27468, mailed on Jan. 4, 2024, 6 pages.

* cited by examiner

SMOKING PIPES

FIELD OF THE DISCLOSURE

This disclosure relates generally to smoking apparatus and, more particularly, to smoking pipes.

BACKGROUND

Smoking pipes are devices used to burn and inhale a variety of substances, for purposes spanning from medicinal needs to recreational uses. Raw smoking materials include substances like tobacco and *cannabis*. There any many configurations of smoking pipes, depending on the volume and type of material to be smoked. Smoking pipes generally include a bowl to gather the smoking material, an opening for the user to draw air through the bowl, and a channel connecting the bowl and opening.

Figure 2:
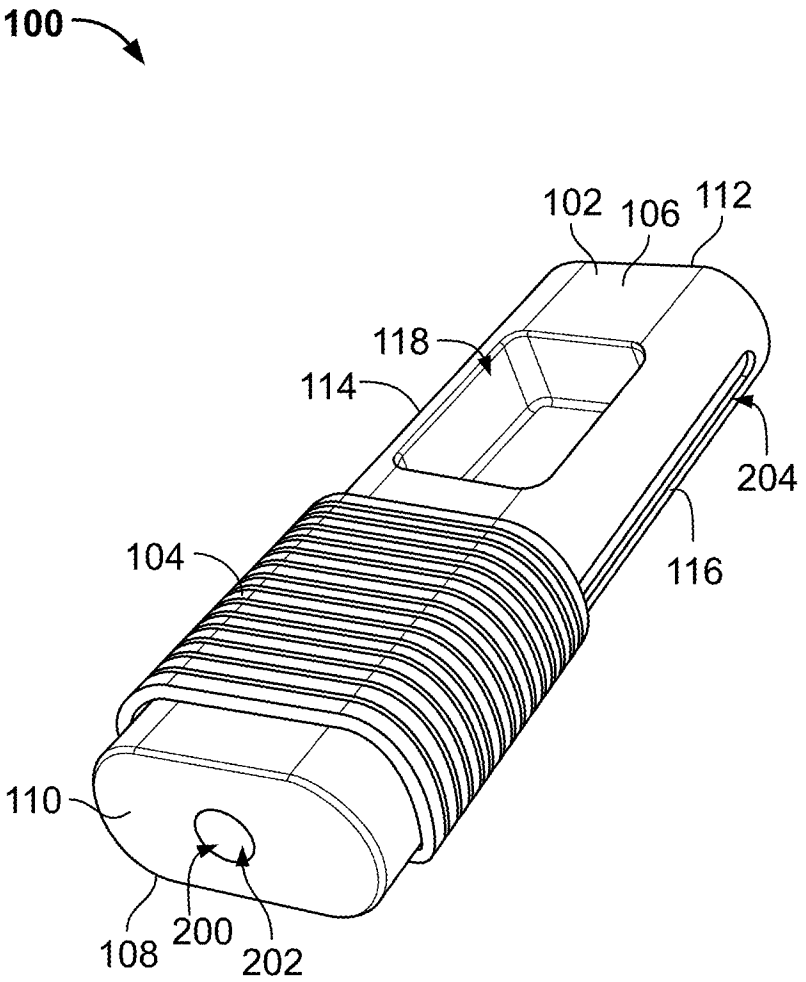
FIG. 2 is a perspective view of an opposite end of the example smoking pipe of FIG. 1.

The figures are not necessarily to scale. Instead, the thickness of the layers or regions may be enlarged in the drawings. Although the figures show layers and regions with clean lines and boundaries, some or all of these lines and/or boundaries may be idealized. In reality, the boundaries and/or lines may be unobservable, blended, and/or irregular. In general, the same reference numbers will be used throughout the drawing(s) and accompanying written description to refer to the same or like parts.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

DETAILED DESCRIPTION

Disclosed herein are example smoking apparatus, referred to herein as smoking pipes, that can be used to smoke a smoking material such as tobacco, cannabis, and/or other plant, herbal, and/or other smokable materials. An example smoking pipe disclosed herein includes a body having a top side with a bowl (e.g., a recess) to receive the smoking material, an end with an opening, and a channel defined in the body between the bowl and the opening to enable a user to draw on the smoking pipe. In some examples disclosed herein, the smoking pipe includes a cover (which may also be referred to as a bowl cover). The cover is moveable or slidable along the body between a first position in which the bowl is exposed or accessible and a second position in which the cover is disposed over the bowl, thereby concealing the bowl. When the cover is in the first position, for example, the bowl can be filled with smoking material and the smoking pipe can be used to smoke the smoking material. When the user is not using the smoking pipe, for example, the user can slide the cover over the bowl to the second position. In some instances, a user can leave unsmoked smoking material and/or partially smoked smoking material in the bowl. As such, the cover can be used to contain any unsmoked and/or partially smoked smoking material in the bowl for later use. In the second position, the cover helps prevent the smoking material from spilling out of the bowl during transportation and/or other movement of the smoking pipe. For example, the user can slide the cover to the second position and then put the smoking pipe in his/her pocket or purse without risk of losing any smoking material from the bowl. Thus, the user does not need to discard the smoking material or transfer the smoking material to another receptacle. Further, the cover in the second position prevents any external debris from entering the bowl and contaminating the smoking material and/or the bowl area. The cover can also be used to extinguish the smoking material when the user desires to stop smoking. For example, if the user desires to stop smoking before all of the smoking material is burnt, the user can slide the cover to the second position. In the second position, the cover limits air flow to the bowl and thereby extinguishes the smoking material. Extinguishing the smoking material reduces or prevents unintended burning of the smoking material, thereby prolonging the life of the smoking material.

In some examples, the cover is annular or cylindrical and at least partially surrounds the body. For example, the cover may be a sleeve that wraps around a portion of the body. In some examples, the cover may be oval, rectangular, rounded rectangular, and/or other shapes. In some examples, the cover remains on the body of the smoking pipe, for ease of user engagement should the user choose to cover the bowl.

Some example smoking pipes disclosed herein include a removable and/or replaceable filter that can be used to prevent solid particulates from the smoking material from flowing into the user's mouth when using the smoking pipe. The removeable filter also serves to absorb excess smoking material or any contaminants that enter the airflow between the bowl and the mouth of the user. Also, the removeable filter serves to mitigate and absorb some of the heat from the smoke before the smoke enters the user's mouth.

Known smoking filters typically sit in the bowl to prevent smoking material in the bowl from entering the channel to the user's mouth. For example, a user typically inserts a filter into the bowl and then packs the smoking material into the bowl on top of the filter. As such, in order to clean and/or replace the filter, the user has to remove all of the smoking material first. This can be cumbersome and messy. Also, known smoking filters are usually sold separately from the smoking material. With separately sold smoking filters, the user has to size the smoking filter for the specific bowl of the smoking pipe and ensure that the smoking filter is correctly sized to adequately serve its filtering purpose.

In some examples disclosed herein the filter is disposed in a separate location than the bowl. For example, the body can include a slot that extends from a side of the body into the channel. The filter can be inserted into the slot such that the filter is disposed in the channel between the bowl and the opening in the end. Therefore, the filter can be removed, inserted, and/or replaced without having to remove the smoking material. In some examples, the slot is formed in a bottom side of the body that is opposite the top side. In some examples, when the cover is moved to the second position, the cover also covers the slot.

In some examples disclosed herein, the smoking pipe includes a screen filter (which may also be referred to as a cartridge) that fits within the bowl. In some examples, the screen filter is pre-filled or packed with smoking material. Therefore, a user can easily insert the screen filter with the smoking material into the bowl and ignite the smoking material. In some examples, the smoking pipe includes a magnet in the bowl, which attracts the screen filter to help hold the screen filter in the bowl. In some examples, the screen filter includes a rim that rests on a shoulder in the bowl of the smoking pipe. In some examples, at least one section of the shoulder is angled relative to the top side of the body. The angled section of the bowl enables a user to press down on the rim of the screen filter to raise the opposite end of the screen filter, which helps with removing the screen filter from the bowl.

Figure 1:
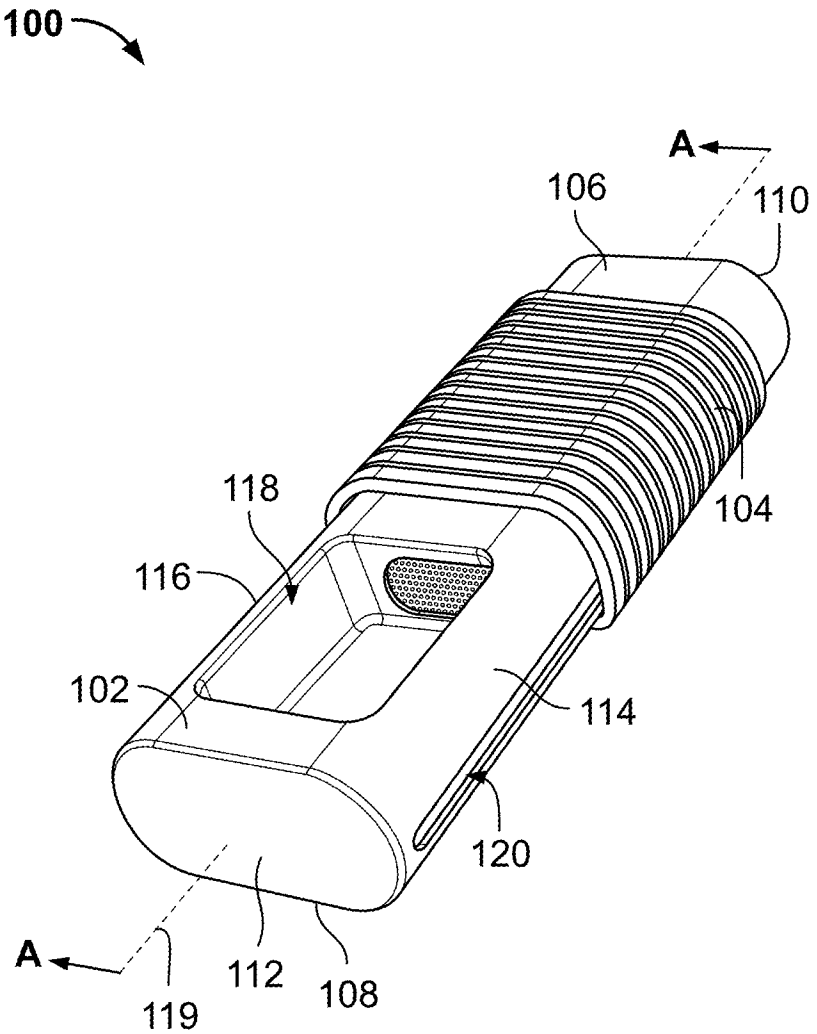
FIG. 1 is a perspective view of an example smoking pipe constructed in accordance with teachings of this disclosure.

Turning now to the figures, FIGS. 1 and 2 illustrate an example smoking pipe 100 constructed in accordance with teachings of this disclosure. The example smoking pipe 100 can be used to contain and burn smoking materials for the purpose of delivering smoke to a user's mouth. In this example, the smoking pipe 100 is generally cylindrical shaped, with flat ends and flat top and bottom sides. In other examples, the smoking pipe 100 can be shaped differently. In some examples, the smoking pipe 100 is sized to fit in a pocket or purse of a user.

FIGS. 1 and 2 are perspective views of opposite ends of the smoking pipe 100. In the illustrated example, the smoking pipe 100 includes an example body 102 and an example cover 104 that is moveable (e.g., slidable) relative to the body 102. In this example, the cover surrounds or wraps around a portion of the body 102. The cover 104 can be used to cover a bowl or recess in the body 102, as disclosed in further detail herein. In the illustrated example, the body 102 includes an example top side 106, an example bottom side 108 opposite the top side 106, an example first end 110, an example second end 112 opposite the first end 110, an example first edge 114, and an example second edge 116 opposite the first edge 114. In this example, the top and bottom sides 106, 108 are flat and the first and second edges 114, 116 are rounded or curved. Therefore, in this example, the body 102 has a stadium shaped cross-section, sometimes referred to as a racetrack shape or a rectangular shape with semi-circular ends. However, in other examples, the body 102 can be shaped differently and have a different cross-sectional shape. The body 102 has an example central or longitudinal axis 119 (FIG. 1). In some examples, the body 102 is constructed (e.g., molded, machined) as a single unitary part or component (e.g., a monolithic structure). In other examples the body 102 can be constructed of multiple parts or components that are coupled together. In some examples, the body 102 is constructed of metal, wood, and/or glass. In other examples, the body 102 can be constructed of other materials and/or combination of materials, such as for example, ceramic or plastic.

As shown in FIGS. 1 and 2, the top side 106 of the body 102 defines an example recess or bore, referred to herein as a bowl 118, for receiving smoking material. In particular, smoking material can be inserted (e.g., packed) into the bowl 118 and ignited (e.g., burned, lit, etc.). As shown in FIG. 2, the first end 110 of the body 102 defines an example opening 200 (e.g., a hole, an aperture) for smoking and interfacing with the user's mouth. The pipe body 102 defines an example channel 202 (shown in further detail in FIG. 7) between the bowl 118 and the opening 200. A user can place his/her mouth on the first end 110 and inhale, which draws air and smoke from the bowl 118 through the channel 202 and out of the opening 200 into the user's mouth.

Figure 3:
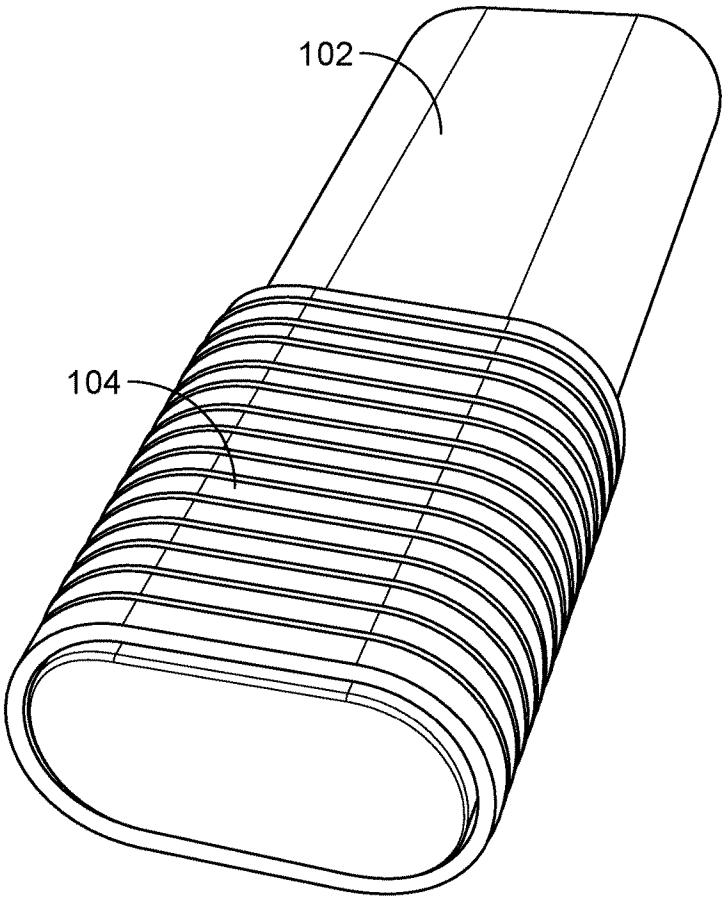
FIG. 3 shows the example smoking pipe of FIGS. 1 and 2 with an example cover in a closed position.

The cover 104 is moveable (e.g., slidable) along the body 102 between a first position in which the bowl 118 is exposed or accessible, and a second position in which the cover 104 covers with the bowl 118. FIGS. 1 and 2 show the cover 104 in the first position. FIG. 3 shows the cover 104 in the second position. As shown in FIG. 3, when the cover 104 is in the second position, the cover 104 conceals or covers the bowl 118 (FIGS. 1 and 2). The cover 104 is slidable along the pipe body 102 between the two positions. In particular, the cover 104 is slidable in a longitudinal direction (e.g., in a direction aligned with the central axis 119 (FIG. 1)) along the body 102 between the first and second positions. In some examples, the first and second positions are the limits that the cover 104 can move in either direction (e.g., one or more stops may prevent further movement). The cover 104 can be moved to the first position (FIGS. 1 and 2) when a user desires to use the smoking pipe 100. When the smoking pipe 100 is not being used, the cover 104 can be moved to the second position (FIG. 3), which covers or conceals the bowl 118. In some examples, smoking material can be left in the bowl 118 and covered with the cover 104. This enables a user to store the smoking material for later use. Therefore, the user does not have to transfer the smoking material into another container. This also helps prevent outside debris and contaminants from entering the bowl 118.

In some examples, an inner surface of the cover 104 is engaged with an outer surface of the body 102. In some examples, the body 102 and the cover 104 are sized to create a certain amount of friction, such that when the cover 104 is slid to the first or second positions (or any position between the first and second positions) and released, the cover 104 remains in the same relative position. However, when a force is applied (e.g., a sufficient amount of force provided by a user), the friction is overcome and the cover 104 slides along the body 102. The user can hold the pipe body 102 stationary while sliding the cover 104 between the two positions, or vice versa, holding the cover 104 and pushing the pipe body 102. In some examples, the cover 104 is textured to enhance the user's grip while engaging with the cover 104. For example, as shown in FIGS. 1-3, at least a portion of an outer surface of the cover 104 is ribbed to enhance grip. Additionally or alternatively, the cover 104 can have other textures and/or patterns. In some examples, the cover 104 is constructed of rubber and/or silicon, which also enhances grip. In other examples, the cover 104 can be constructed of other materials and/or combination of materials (e.g., wood and/or metal).

As shown in FIGS. 1-3, the cover 104 is cylindrical shaped and surrounds the body 102. The cover 104 has a same or matching or complementary shape as the body 102. In other examples, the cover 104 may only partially surround the body 102. In some examples, the cover 104 may be removably clipped onto the body 102. In the illustrated example, the cover 104 remains on the smoking pipe 100. However, in other examples, the cover 104 can be removed from (e.g., slid off of) the body 102. As shown in FIGS. 1 and 2, the first edge 114 defines an example first groove 120 and the second edge 116 defines an example second groove 204. The grooves 120, 204 form tracks that guide movement of the cover 104 along the body 102.

Figure 4:
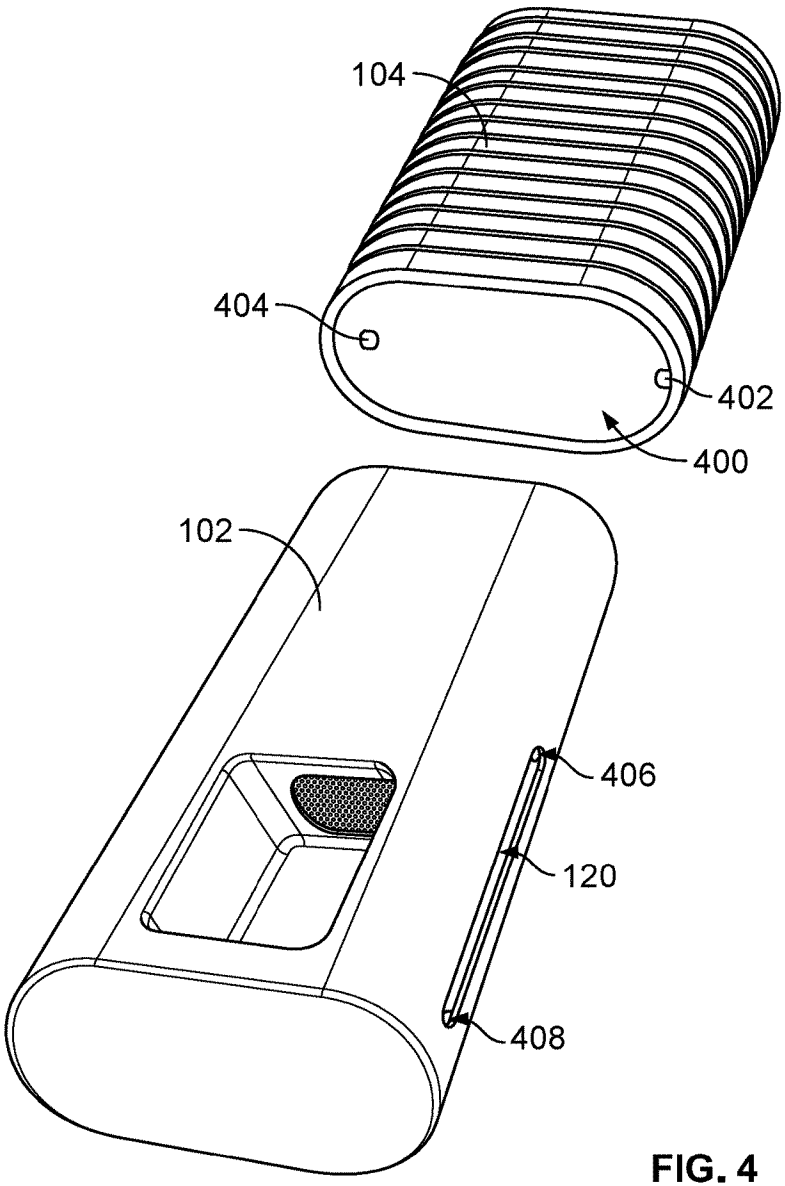
FIG. 4 is an exploded perspective view of the example smoking pipe of FIGS. 1 and 2.

FIG. 4 is an exploded view of the body 102 and the cover 104. As shown in FIG. 4, the cover 104 forms or defines an example opening 400. When the smoking pipe 100 is assembled, the body 102 extends through the opening 400 of the cover 104. As shown in FIG. 4, the cover 104 includes example first and second protrusions 402, 404. When the cover 104 is disposed on the body 102, the first and second protrusions 402, 404 extend into the first and second grooves 120, 204, respectively. The protrusions 402, 404 and the grooves 120, 204 ensure the cover 104 slides lengthwise along the body 102 and prevents the cover 104 from rotating relative to the body 102. The ends of the grooves 120, 204 form limits or stops that define the first and second positions of the cover 104. In some examples, body 102 includes a detent feature to hold the cover 104 in the first (open) or second (closed) positions. For example, in FIG. 4, one end of the groove 120 has a first detent 406 and the opposite end of the groove 120 has a second detent 408. The first protrusion 402 may extend into the first or second detents 406, 408 to temporarily lock the cover 104 in the open or closed positions. While in this example the smoking pipe 100 has two grooves, in other examples the smoking pipe 100 may include a different number of grooves such as, for example, one groove. Further, in other examples, the protrusions(s) may be formed on the body 102, and the cover 104 may include the grooves and/or detent(s).

Figure 6:
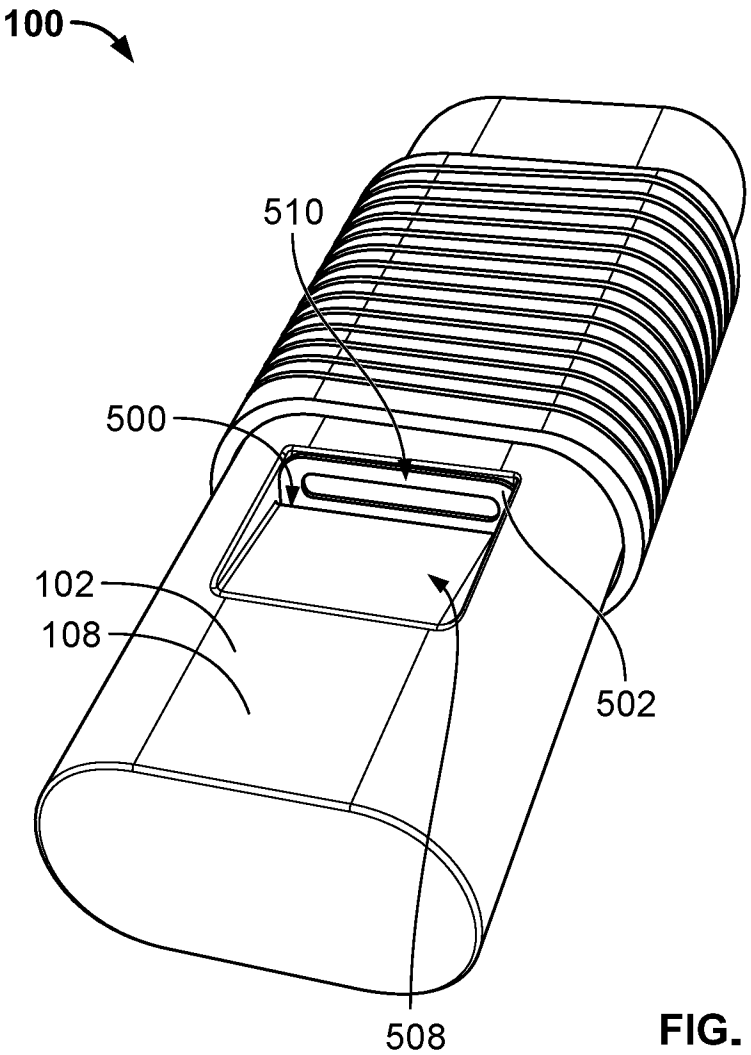
FIG. 6 shows the example filter of FIG. 5 inserted into the example slot.
Figure 5:
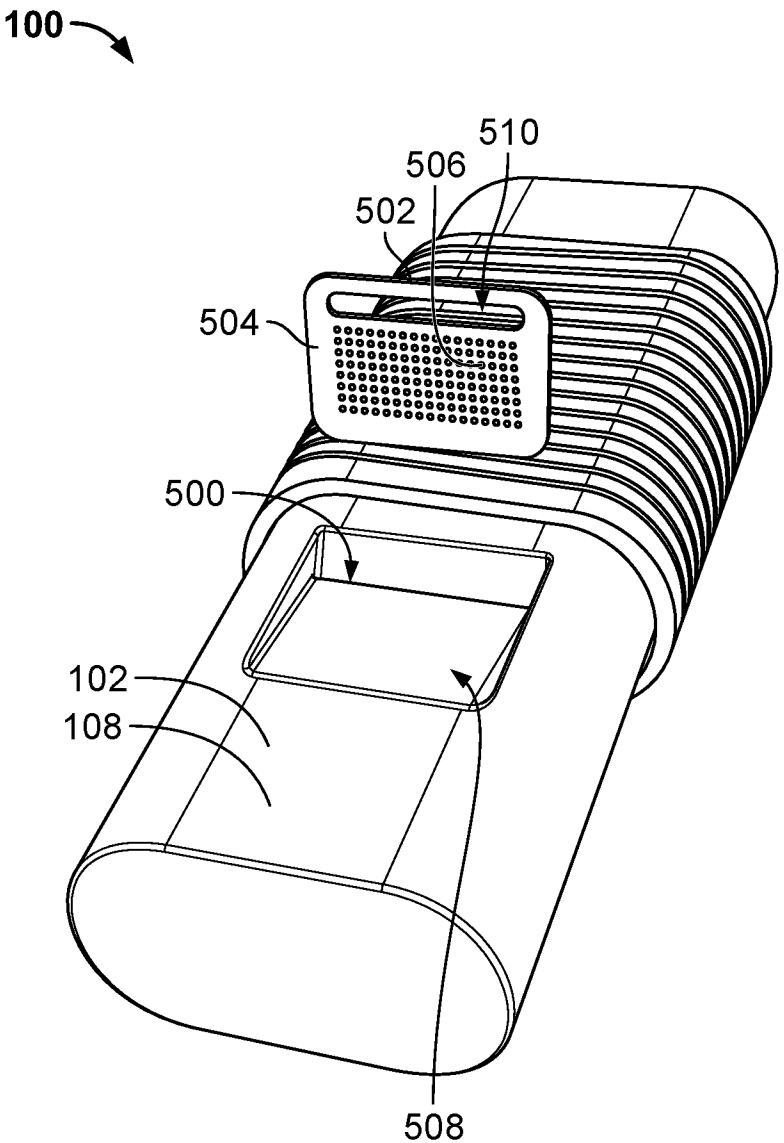
FIG. 5 is a perspective view of a bottom side of the example smoking pipe of FIGS. 1 and 2 and showing an example filter to be inserted into an example slot in the example smoking pipe.

In some examples, the smoking pipe 100 includes a filter (which may also be referred to as a screen or screen filter). For example, FIGS. 5 and 6 are perspective views of the bottom side 108 of the example smoking pipe 100. In the illustrated example, the body 102 defines an example opening 500 to receive an example filter 502. FIG. 5 shows the filter 502 separated from the body 102, and FIG. 6 shows the filter 502 inserted into the opening 500. In this example, the opening 500 is a slot and is referred to herein as the filter slot 500. However, in other examples, the opening 500 can be shaped differently. In this example, the filter slot 500 is formed or defined in the bottom side 108 of the body 102 and extends into the channel 202 (shown in further detail in FIG. 7). In other examples, the filter slot 500 can be formed in another side or surface of the body 102 (e.g., the top side 106, the first edge 114, the second edge 116, etc.). In some examples, the filter 502 is held in the filter slot 500 via friction. The friction is a sufficient amount to hold the filter 502 in the filter slot 500 during use, but still allows a user to remove the filter 502 with his/her finger. In this example, the filter slot 500 is in an area defined separately from the bowl 118. Therefore, unlike known smoking pipes, the filter 502 is not inserted into the bowl 118. This enables a user to remove, clean, insert, and/or replace the filter 502 without having to remove any or all of the smoking material from the bowl 118. In this example, when the cover 104 is in the first position, the filter slot 500 is accessible or exposed, and when the cover 104 is in the second position (shown in FIG. 3), the filter slot 500 is covered or concealed by the cover 104. Concealing the filter 502 with the cover 104 prevents or limits the filter 502 from extending from and/or falling out of the filter slot 500. Therefore, when the cover 104 is in the first position, the bowl 118 and the filter slot 500 are accessible, and when the cover 104 is in the second position the bowl 118 and the filter slot 500 are covered.

In the illustrated example of FIG. 5, the filter 502 is square-shaped. For example, the filter 502 may be constructed from a flat plate. In some examples, the filter 502 is constructed of metal, such as stainless steel or aluminum. In this example, the filter 502 has an example solid outer perimeter 504 and an example meshed central region 506. When the filter 502 is disposed in the filter slot 500, the meshed central region 506 aligns or is otherwise disposed in the channel (shown in FIG. 7). As such, air flows through the meshed central region 506. In other examples, the filter 502 can be shaped differently, such as circular (e.g., disc-shaped), triangular, etc.

As shown in FIGS. 5 and 6, the bottom side 108 of the body 102 defines an example sloped recess 508 adjacent to the filter slot 500. The sloped recess 508 can be used to guide a finger of a user into the filter 502 to assist in removal of the filter 502 from the filter slot 500. For example, a user can slide his/her index finger along the sloped recess 508 to the filter 502. Then, the user can use his/her index finger or nail to pull the filter 502 out of the filter slot 500. In the illustrated example, the solid outer perimeter 504 defines an example slot 510. When the filter 502 is inserted into the filter slot 500, the slot 510 remains exposed. The slot 510 in the filter 502 enables a finger or nail of a user to engage the filter 502 for removal of the filter 502 from the filter slot 500.

Figure 7:
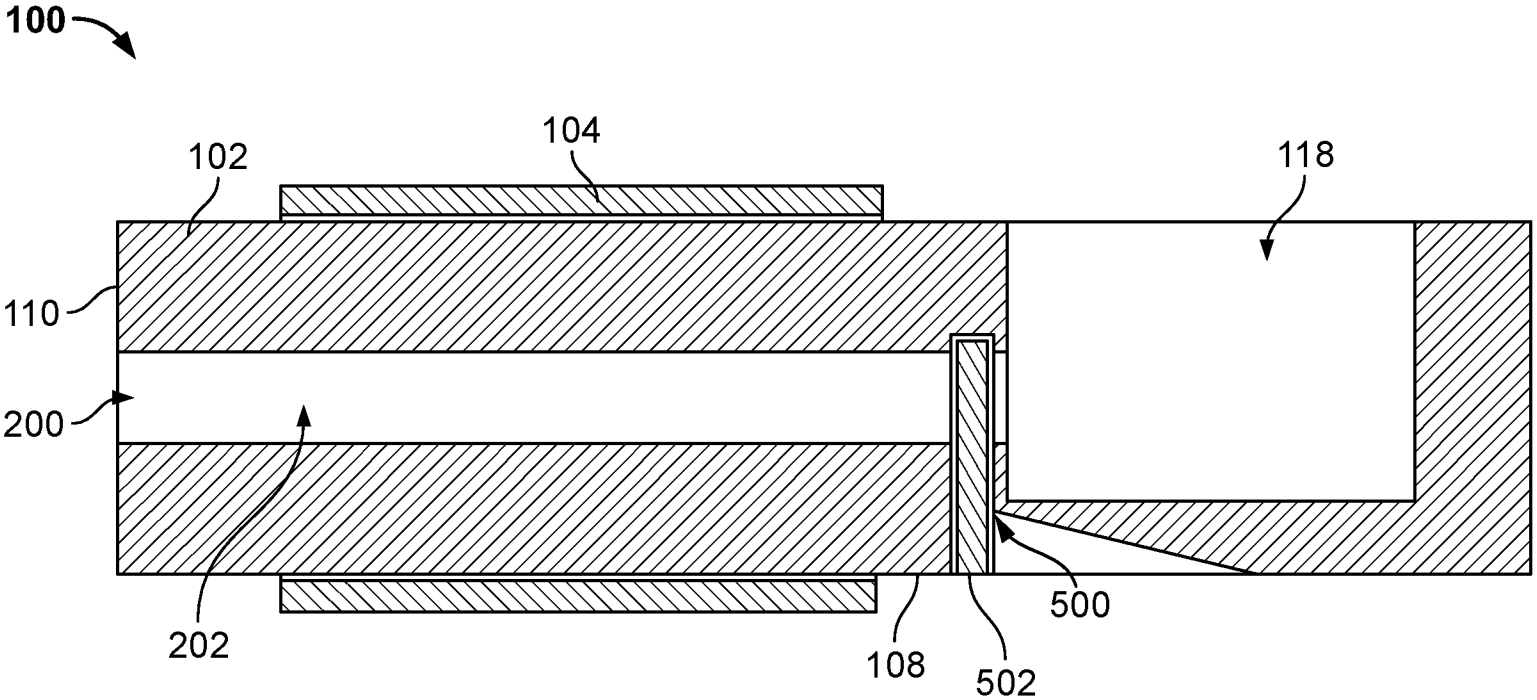
FIG. 7 is a cross-sectional view of the example smoking pipe of FIGS. 1 and 2 taken along line A-A of FIG. 1.

FIG. 7 is a cross-sectional view of the example smoking pipe 100 taken along line A-A of FIG. 1. In FIG. 7, the cover 104 is in the first position, exposing both the bowl 118 and the filter slot 500. As shown in FIG. 7, the body 102 defines the channel 202 that extends between the bowl 118 and the opening 200 in the first end 110. The filter slot 500 extends from the bottom side 108 and into the channel 202. As such, when the filter 502 is inserted into the filter slot 500, the filter 502 is disposed in the channel 202 between the bowl 118 and the opening 200. When a user draws on the opening 200, smoke and air from the bowl 118 is drawn across the filter 502 and through the channel 202 to the opening 200. The filter 502 prevents and/or reduces particulate (e.g., smoking material, ash, resin, etc.) from reaching the mouth of the user. In the illustrated example the filter slot 500 extends into the body 102 in a direction that is perpendicular to the channel 202. In other examples, the filter slot 500 can be angled relative to the channel 202. In the illustrated example, the filter slot 500 is closer to the bowl 118 than the first end 110. In other examples, the filter slot 500 can be defined in another location.

Figure 9:
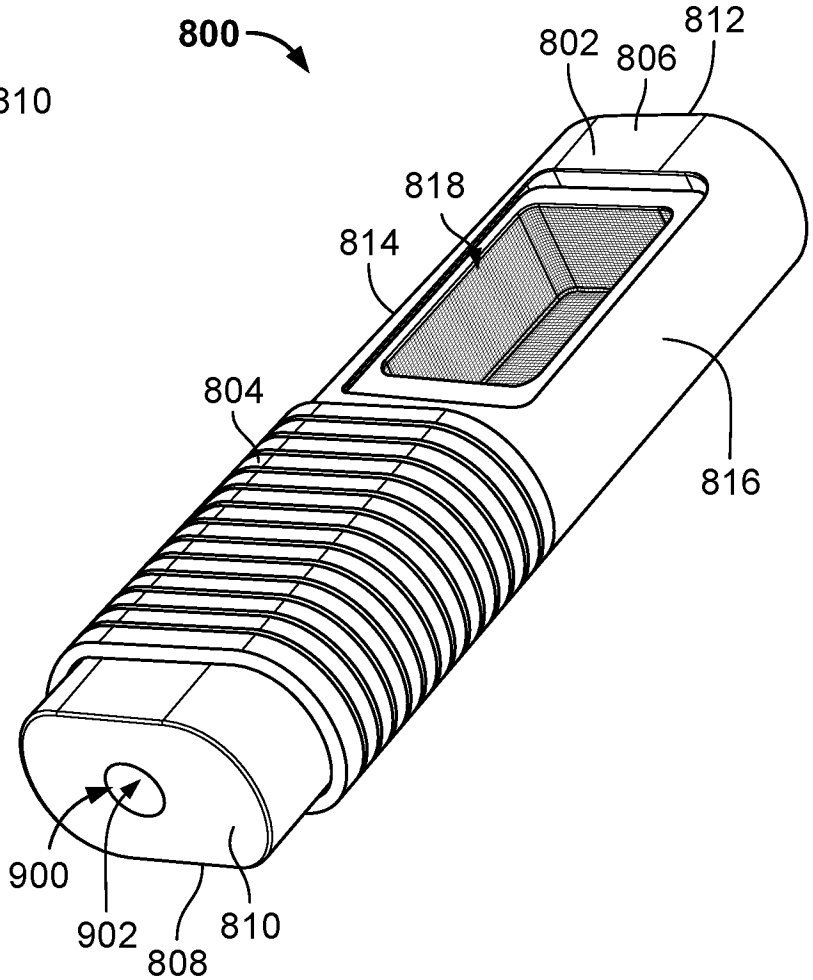
FIG. 9 is a perspective view of an opposite end of the example smoking pipe of FIG. 8.
Figure 8:
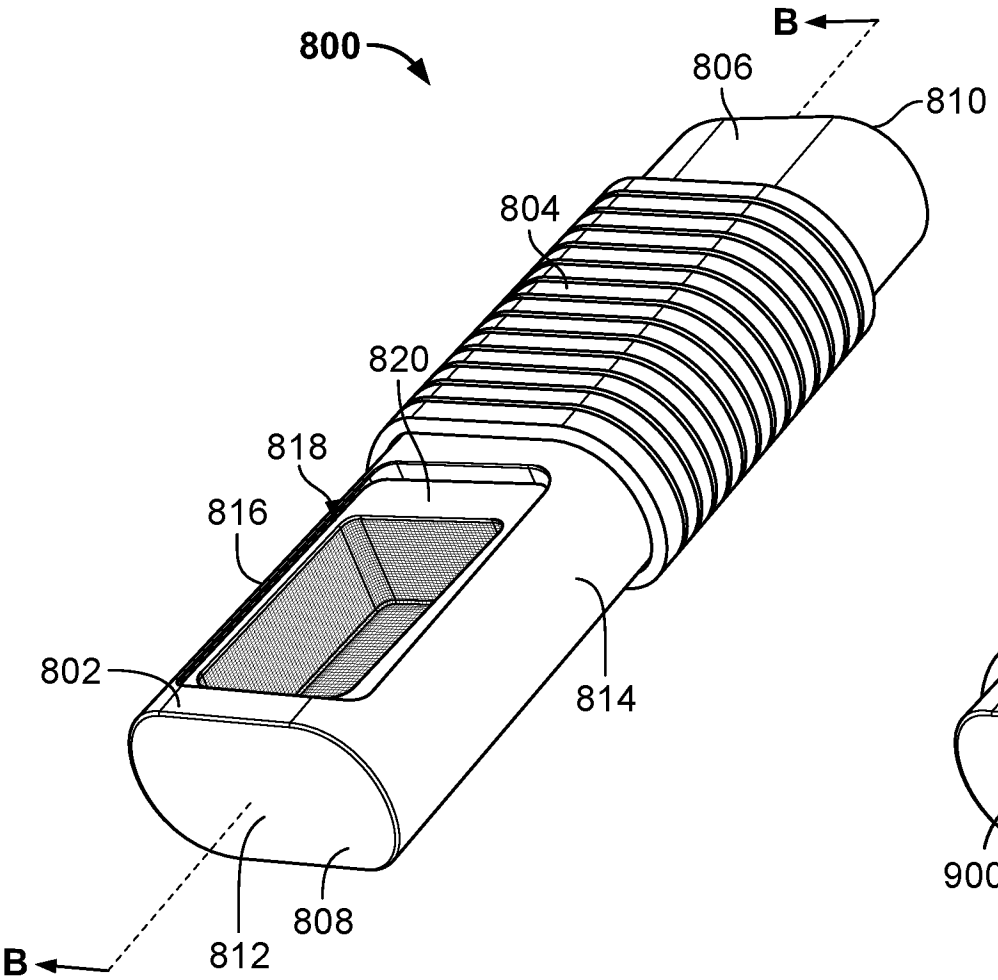
FIG. 8 is a perspective view of another example smoking pipe constructed in accordance with teachings of this disclosure.
Figure 10:
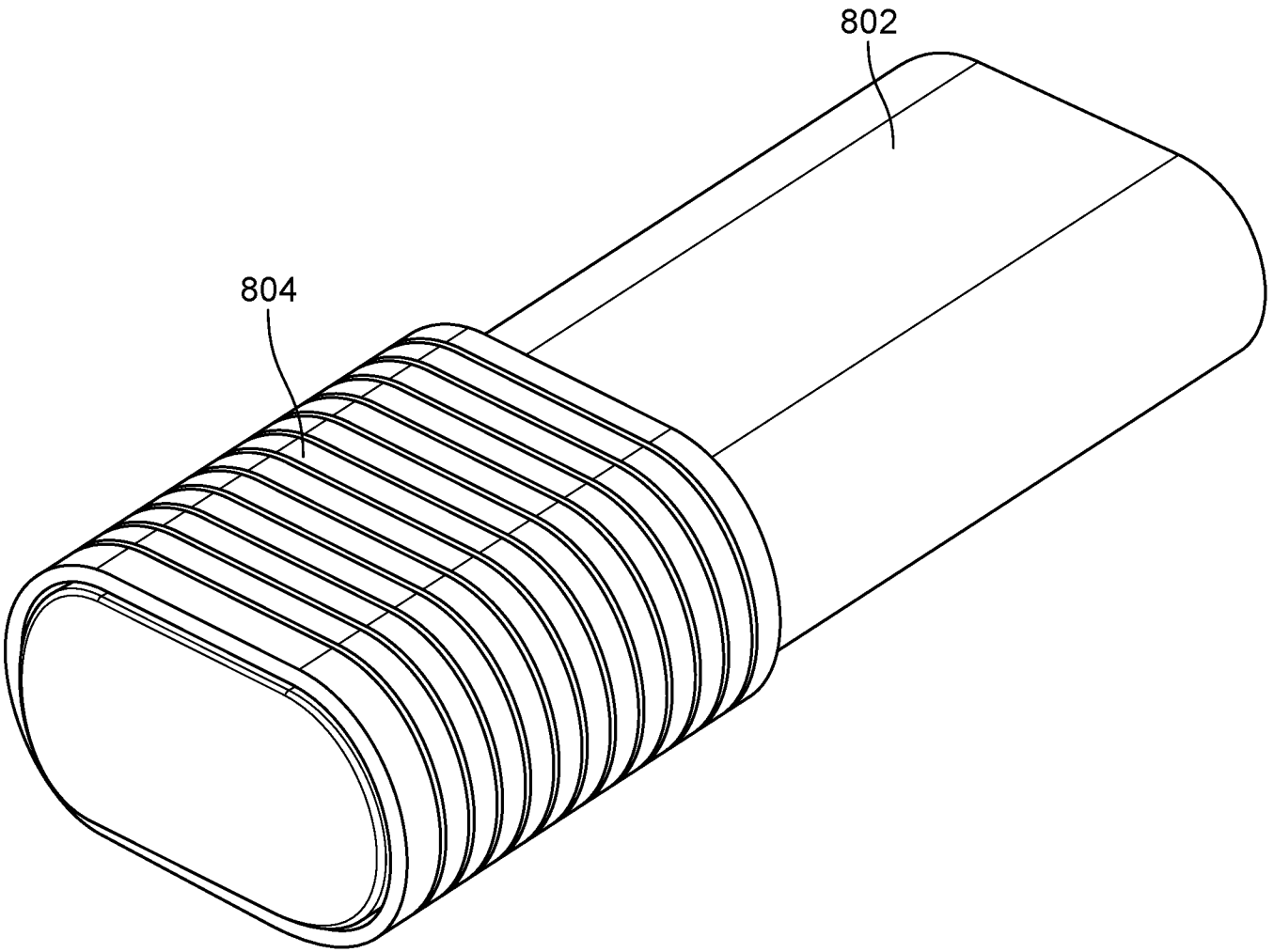
FIG. 10 shows the example smoking pipe of FIGS. 8 and 9 with an example cover in a closed position.

FIGS. 8 and 9 illustrate another example smoking pipe 800 constructed in accordance with teachings of this disclosure. FIGS. 8 and 9 show opposite ends of the example smoking pipe 800. The example smoking pipe 800 is similar to the example smoking pipe 100. In particular, the smoking pipe 800 includes an example body 802 and an example cover 804. The body 802 includes an example top side 806, an example bottom side 808 opposite the top side 806, an example first end 810, an example second end 812 opposite the first end 810, an example first edge 814, and an example second edge 816 opposite the first edge 814. As shown in FIGS. 8 and 9, the top side 806 of the body 802 defines an example recess or bore, referred to herein as a bowl 818, to receive smoking material. As shown in FIG. 9, the first end 810 of the body 802 defines an example opening 900 (e.g., a hole, an aperture). The body 802 defines an example channel 902 (shown in further detail in FIG. 13) between the bowl 818 and the opening 900. The cover 804 is moveable (e.g., slidable) along the body 802 between a first position in which the bowl 818 is exposed or accessible, and a second position in which the cover 804 covers the bowl 818. FIGS. 8 and 9 show the cover 804 in the first position, and FIG. 10 shows the cover 804 in the second position. The body 802 has the same shape as the body 102 of the smoking pipe 100 disclosed above. Further, the cover 804 is moveable (e.g., slidable) along the body 802 between the first and second positions in the same manner as the cover 104 disclosed above. To avoid redundancy, a description of these features is not repeated. Instead, any of the example aspects or features disclosed above in connection with the body 102 and the cover 104 can likewise apply to the body 802 and the cover 804.

In this example, the smoking pipe 800 includes an example screen filter 820, which may also be referred to as a filter cartridge. In FIGS. 8 and 9, the screen filter 820 is disposed in the bowl 818. The screen filter 820 serves a dual purpose of containing smoking material and filtering the smoke as previously discussed. In some examples, the screen filter 820 is pre-filled with smoking material. For example, a manufacturer can sell screen filters that are pre-filled (e.g., packed) with different types of smoking material. As such, a user can easily insert a screen filter into the bowl 818 and smoke the smoking material. Pre-filled filter screens make packing and removing the smoking material less cumbersome. In other examples, the screen filter 820 may be empty, and the user may insert their own smoking material. The screen filter 820 in this example is shaped similarly or complementary to the bowl 818, but the screen filter 820 is sized slightly smaller than the bowl 818, such that the screen filter 820 will sit inside of the bowl 818. Further, in this example, when the screen filter 820 is disposed in the bowl 818, the screen filter 820 sits below the plane of the top side 806. As such, when the cover 804 is moved to the second position (as shown in FIG. 10), the cover 804 covers the screen filter 820. Covering the screen filter 820 enables a user to store the screen filter 820 and smoking material in the bowl 818 for later use.

Figure 11:
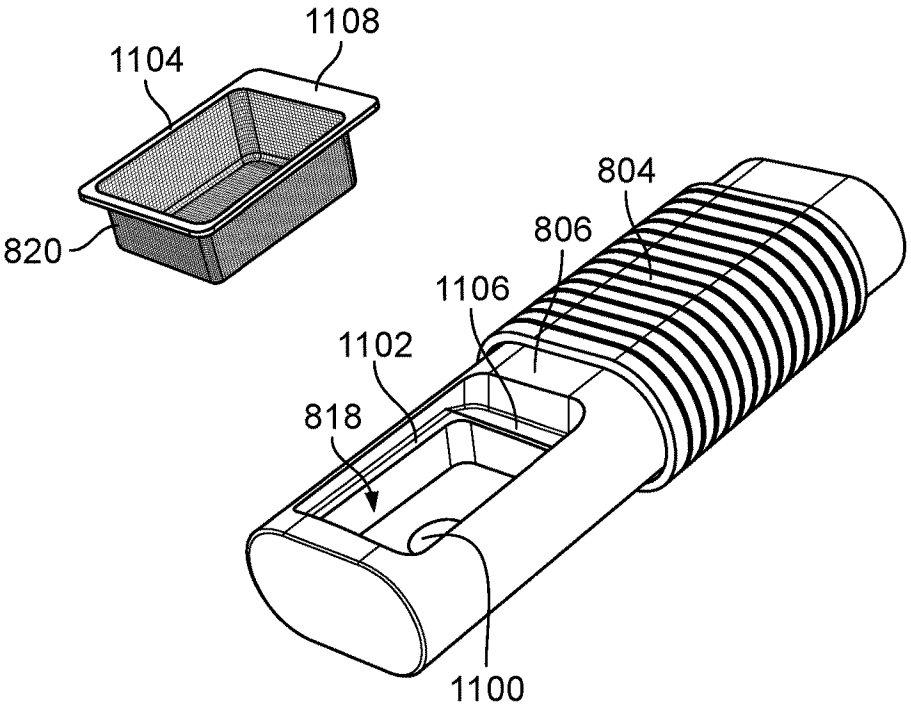
FIG. 11 shows an example screen filter that can be inserted into an example bowl of the example smoking pipe of FIGS. 8 and 9.

FIG. 11 shows the screen filter 820 removed from the bowl 818. The screen filter 820 is box or cuboid shaped, which matches or substantially matches or complements the shape of the bowl 818. In other examples, the screen filter 820 can be shaped differently. The walls of the screen filter 820 are meshed. In some examples, the screen filter 820 is constructed of metal, such as, for example, stainless steel or aluminum.

In some examples, to hold the screen filter 820 in the bowl 818, the smoking pipe 800 includes an example magnet 1100. In this example, the magnet 1100 is disposed in the bottom of the bowl 818 (e.g., in a recess formed in the bottom of the bowl 818). The magnet 1100 magnetically attracts the screen filter 820 to hold the screen filter 820 in the bowl 818. The strength of the magnet 1100 is strong enough to hold the screen filter 820 in the bowl 818 during use, but still allows a user to remove the screen filter 820 with his/her finger(s).

In the illustrated example of FIG. 11, the bowl 818 has an example shoulder 1102 (e.g., a ledge) around or encompassing the bowl 818. The screen filter 820 has an example flat upper rim 1104 to rest on the shoulder 1102. In particular, when the screen filter 820 is inserted into the bowl 818, the rim 1104 engages or rests on the shoulder 1102, thereby supporting the screen filter 820 in the bowl 818. In the illustrated example, the shoulder 1102 is recessed below the top side 806 by at least the thickness of the rim 1104. Therefore, when the screen filter 820 is inserted into the bowl 818, the screen filter 820 (including the rim 1104) is disposed entirely flush with or below the top side 806. This enables the cover 104 to be slid over the bowl 818 and the screen filter 820 to the second position shown in FIG. 10.

Figure 12:
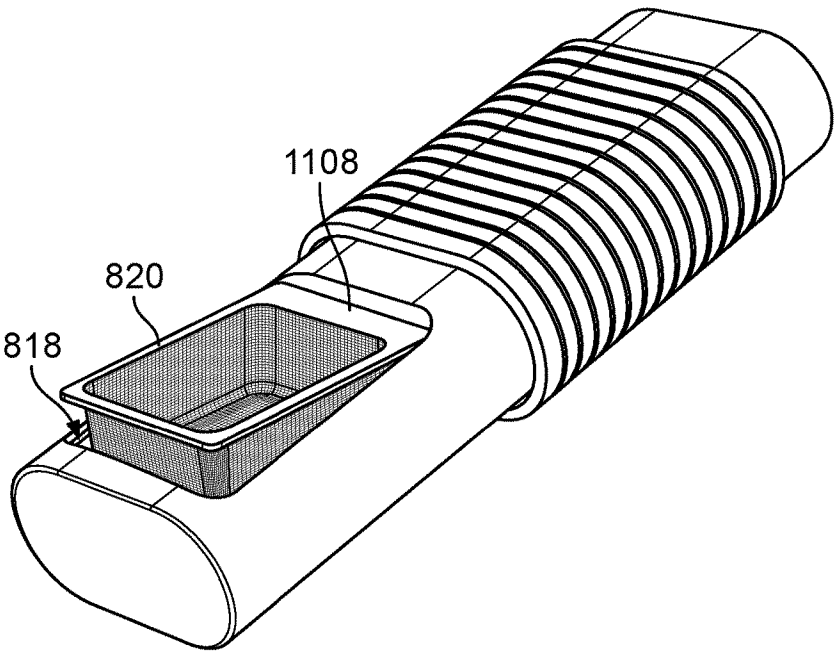
FIG. 12 shows the example screen filter of FIG. 11 partially inserted into the example bowl of the example smoking pipe.

The example smoking pipe 800 includes one or more features to assist in removing the screen filter 820 from the bowl 818. In the illustrated example, an example section 1106 of the shoulder 1102 is angled relative to the top side 806 of the body 802. In particular, the section 1106 of the shoulder 1102 is sloped downward in a direction away from the bowl 818. The rim 1104 of the screen filter 820 has an example elongated section 1108 that corresponds to the section 1106. The section 1106 enables a user to press down on the elongated section 1108 of the rim 1104 to raise an opposite side of the screen filter 820 upward. For example, as shown in FIG. 12, a user presses the elongated section 1108 downward and into the section 1106 (FIG. 11) of the shoulder 1102. As a result, the opposite end of the screen filter 820 raises or lifts out of the bowl 818, which enables the user to grab the screen filter 820 and remove the filter 820 from the bowl 818. Because the screen filter 820 may contain the smoking material, a user can remove the screen filter 820, containing spent or partially smoking material, without having to clean or empty the bowl 818.

Figure 13:
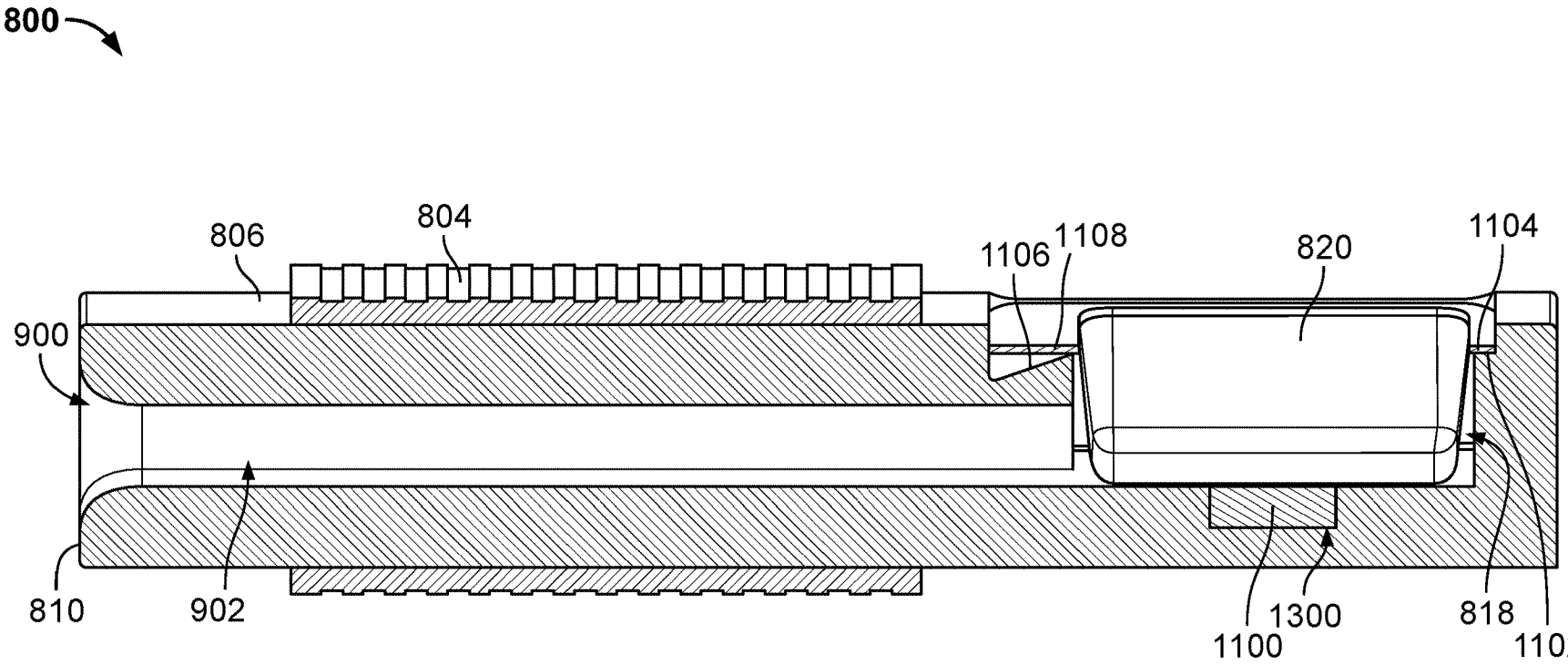
FIG. 13 is a cross-sectional view of the example smoking pipe of FIGS. 8 and 9 taken along line B-B of FIG. 8.

FIG. 13 is a cross-sectional view of the example smoking pipe 800 taken along line B-B of FIG. 8. In FIG. 13, the cover 804 is in the first position, exposing the bowl 818 containing the screen filter 820. As shown in FIG. 13, the body 802 defines the channel 902 that extends between the bowl 818 and the opening 900 in the first end 810. In the illustrated example, the magnet 1100 is located in an example recess 1300 (e.g., via friction fit) formed in the bottom of the bowl 818 such that when the screen filter 820 is disposed in the bowl 818, the magnet 1100 holds the screen filter 820 in the bowl 818. When a user draws on the opening 900, smoke and air from the bowl 818 is drawn through the screen filter 820 and through the channel 902 to the opening 900. The screen filter 820 prevents or reduces particulate from reaching the mouth of the user.

In the illustrated example, the rim 1104 of the screen filter 820 rests on the shoulder 1102. In some examples, one or more sides and/or the bottom of the screen filter 820 rest on and/or engage one or more sides of the bowl 818. As shown in FIG. 13, the section 1106 of the shoulder 1102 is angled downward relative to the top side 806. Therefore, when a user presses downward on the elongated section 1108 of the rim 1104, the opposite end of the screen filter lifts or raises from the bowl 818, as shown in FIG. 12. While in this example only one section of the shoulder 1102 is angled, in other example, multiple sections of the shoulder 1102 may be angled.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects and/or things, the phrase "at least one of A and B" is intended to refer to implementations including any of (1) at least one A, (2) at least one B, or (3) at least one A and at least one B. Similarly, as used herein in the context of describing structures, components, items, objects and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements or method actions may be implemented by, e.g., the same entity or object. Additionally, although individual features may be included in different examples or claims, these may possibly be combined, and the inclusion in different examples or claims does not imply that a combination of features is not feasible and/or advantageous.

Examples and combinations of examples disclosed herein include the following:

Example 1 is a smoking pipe comprising a body including a bowl to receive smoking material, an end defining a first opening for smoking, and a channel defined in the body between the bowl and the first opening. The smoking pipe includes a cover defining a second opening. The body extends through the second opening of the cover. The cover is slidable in a longitudinal direction along the body between a first position in which the bowl is accessible and a second position in which the bowl is covered.

Example 2 includes the smoking pipe of Example 1, wherein the body includes a groove, and wherein the cover includes a protrusion extending into the groove. The groove is to guide movement of the cover along the body.

Example 3 includes the smoking pipe of Examples 1 or 2, wherein at least a portion of an outer surface of the cover is ribbed.

Example 4 includes the smoking pipe of any of Examples 1-3, wherein the body has a stadium shaped cross-section.

Example 5 includes the smoking pipe of any of Examples 1-4, wherein the body defines a slot to receive a filter. The slot extends from a side of the body into the channel.

Example 6 includes the smoking pipe of Example 5, wherein, when the cover is in the first position, the slot is accessible, and when the cover is in the second position, the slot is covered.

Example 7 includes the smoking pipe of Example 6, wherein the bowl is formed in a first side of the body and the slot is formed in a second side of the body opposite the first side.

Example 8 is a smoking pipe comprising a body including a bowl to receive smoking material, an end defining a first opening, a channel defined in the body between the bowl and the first opening, and a second opening formed in the body to receive a filter. The second opening extends from a side of the body into the channel.

Example 9 includes the smoking pipe of Example 8, wherein the second opening is a slot.

Example 10 includes the smoking pipe of Example 9, wherein the body includes a top side and a bottom side opposite the top side. The bowl is formed in the top side, and the slot is formed in the bottom side.

Example 11 includes the smoking pipe of Example 10, wherein the slot extends into the body in a direction that is perpendicular to the channel.

Example 12 includes the smoking pipe of any of Examples 8-11, wherein the body defines a sloped recess adjacent to the second opening to guide a finger of a user for removal of the filter from the second opening.

Example 13 includes the smoking pipe of any of Examples 8-12, further including a cover that is slidable along the body, wherein the cover is slidable between a first position in which the bowl and the second opening are accessible and a second position in which the bowl and the second opening are covered.

Example 14 includes the smoking pipe of any of Examples 8-13, further including the filter, wherein the filter is square-shaped with a solid outer perimeter and a meshed central region.

Example 15 includes the smoking pipe of Example 14, wherein the solid outer perimeter defines a slot to enable a finger of a user to engage the filter for removal of the filter from the second opening.

Example 16 is a smoking pipe comprising a body including a top side defining a bowl to receive a screen filter. The bowl has a shoulder to be engaged by a rim of the screen filter when the screen filter is inserted into the bowl. At least one section of the shoulder being angled relative to the top side to enable a user to press down on the rim of the screen filter to raise an opposite side of the screen filter upward. The body also includes an end defining an opening to interface a mouth and a channel defined in the body between the bowl and the opening.

Example 17 includes the smoking pipe of Example 16, wherein the shoulder is recessed below the top side, such that when the screen filter is inserted into the bowl, the screen filter is disposed below the top side.

Example 18 includes the smoking pipe of Examples 16 or 17, further including a magnet disposed in the bowl. The magnet is to magnetically attract the screen filter to hold the screen filter in the bowl.

Example 19 includes the smoking pipe of any of Examples 16-18, further including the screen filter, wherein the screen filter is cuboid shaped.

Example 20 includes the smoking pipe of Example 19, wherein the screen filter has a flat upper rim to rest on the shoulder.

Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

The following claims are hereby incorporated into this Detailed Description by this reference, with each claim standing on its own as a separate embodiment of the present disclosure.

What is claimed is:

1. A smoking pipe comprising:

a body including:

a top side defining a bowl to receive smoking material;

an end defining a first opening for smoking;

a channel defined in the body between the bowl and the first opening; and a bottom side opposite the top side, the bottom side having a slot configured to receive a filter to catch particulate from the smoking material, the slot extending from an exterior surface of the bottom side into the channel, the filter defining part of the exterior surface of the bottom side, the bottom side forming a wall between the bowl and the slot such that the filter is disposed outside of the bowl, the channel extending through the wall; and a cover defining a second opening, the body extending through the second opening of the cover, the cover slidable in a longitudinal direction along the body between a first position in which the bowl is accessible and a second position in which the bowl is covered.

2. The smoking pipe of claim 1, wherein the body includes a groove, and wherein the cover includes a protrusion extending into the groove, the groove to guide movement of the cover along the body.

3. The smoking pipe of claim 1, wherein at least a portion of an outer surface of the cover is ribbed.

4. The smoking pipe of claim 1, wherein the body has a stadium shaped cross-section.

5. The smoking pipe of claim 1, wherein, when the cover is in the first position, the slot is accessible, and when the cover is in the second position, the slot is covered.

6. The smoking pipe of claim 1, further including the filter, the filter disposed in the slot.

7. The smoking pipe of claim 6, wherein the filter has a meshed region that is aligned with the channel.

8. The smoking pipe of claim 7, wherein the filter has a solid outer perimeter around the meshed region.

9. The smoking pipe of claim 8, wherein the slot is a first slot, wherein the solid outer perimeter of the filter has a second slot to enable a finger of a user to engage the filter for removal of the filter from the first slot.

10. The smoking pipe of claim 9, wherein the bottom side of the body defines a sloped recess adjacent to the first slot, and wherein, when the filter is disposed in the first slot, the second slot of the filter is exposed by the sloped recess.

11. The smoking pipe of claim 6, wherein the filter is a flat plate.

12. The smoking pipe of claim 1, wherein the bowl is defined by a side surface and a continuous bottom surface.

13. A smoking pipe comprising:

a body including:

a top side defining a bowl to receive smoking material, the bowl defined by a side surface and a continuous bottom surface;

an end defining a first opening;

a channel defined in the body between the side surface of the bowl and the first opening; and a bottom side opposite the top side, an exterior surface of the bottom side defining a second opening configured to receive a filter, the filter defining part of the exterior surface of the bottom side, the second opening extending into the channel at a location between the side surface and the end such that the filter is outside of the bowl.

14. The smoking pipe of claim 13, wherein the second opening is a slot.

15. The smoking pipe of claim 14, wherein the slot extends into the body in a direction that is perpendicular to the channel.

16. The smoking pipe of claim 13, wherein the bottom side of the body defines a sloped recess adjacent to the second opening to guide a finger of a user for removal of the filter from the second opening.

17. The smoking pipe of claim 13, further including a cover that is slidable along the body, wherein the cover is slidable between a first position in which the bowl and the second opening are accessible and a second position in which the bowl and the second opening are covered.

18. The smoking pipe of claim 13, further including the filter, wherein the filter is square-shaped with a solid outer perimeter and a meshed central region.

19. The smoking pipe of claim 18, wherein the solid outer perimeter defines a slot to enable a finger of a user to engage the filter for removal of the filter from the second opening.

* * * * *